US009242835B2

(12) United States Patent
Björni et al.

(10) Patent No.: US 9,242,835 B2
(45) Date of Patent: Jan. 26, 2016

(54) ELEVATOR AND GUIDE RAIL BRACKET

(75) Inventors: Osmo Björni, Hyvinkää (FI); Antti Saarelainen, Espoo (FI); Erik Lindfors, Vantaa (FI)

(73) Assignee: KONE CORPORATION, Helsinki (FI)

( * ) Notice: Subject to any disclaimer, the term of this patent is extended or adjusted under 35 U.S.C. 154(b) by 703 days.

(21) Appl. No.: 13/529,235

(22) Filed: Jun. 21, 2012

(65) Prior Publication Data

US 2012/0312640 A1 Dec. 13, 2012

Related U.S. Application Data

(63) Continuation of application No. PCT/FI2010/051081, filed on Dec. 22, 2010.

(30) Foreign Application Priority Data

Dec. 22, 2009 (FI) ..... 20090502
Feb. 4, 2010 (FI) ..... 20100041

(51) Int. Cl.
*B66B 7/02* (2006.01)
*B66B 7/00* (2006.01)
*E04B 1/38* (2006.01)

(52) U.S. Cl.
CPC ..... *B66B 7/023* (2013.01); *B66B 7/024* (2013.01); *E04B 2001/405* (2013.01)

(58) Field of Classification Search
CPC .... B66B 7/023; B66B 7/024; Y10T 29/49948
USPC ..... 187/408
See application file for complete search history.

(56) References Cited

U.S. PATENT DOCUMENTS

| | | | | | |
|---|---|---|---|---|---|
| 4,431,087 | A * | 2/1984 | Karol | ..... | 187/408 |
| 4,577,729 | A * | 3/1986 | Karol | ..... | 187/408 |
| 4,716,991 | A * | 1/1988 | Riechers | ..... | 187/409 |
| 5,316,108 | A * | 5/1994 | Pearson | ..... | 187/408 |
| 6,371,249 | B1 * | 4/2002 | Schops et al. | ..... | 187/408 |

FOREIGN PATENT DOCUMENTS

| | | | | |
|---|---|---|---|---|
| ES | 2255370 | A1 | 6/2006 | |
| GB | 2083111 | A | 3/1982 | |
| JP | 10-297842 | A | 11/1998 | |
| JP | 2002-104754 | A | 4/2002 | |
| JP | 2007186328 | A | 7/2007 | |
| WO | WO 2011117457 | A1 * | 9/2011 | ..... B66B 7/02 |

OTHER PUBLICATIONS

International Search Report PCT/ISA/210 dated May 5, 2011 for International Application No. PCT/FI2010/051081.
Written Opinion PCT/ISA/237 dated May 5, 2011 for International Application No. PCT/FI2010/051081.

* cited by examiner

*Primary Examiner* — William A Rivera
*Assistant Examiner* — Stefan Kruer
(74) *Attorney, Agent, or Firm* — Harness, Dickey & Pierce, P.L.C.

(57) ABSTRACT

Elevator, which includes a guide rail line, which includes a plurality of consecutive guide rails, which are supported on the building with guide rail brackets fixed to the building, which guide rail brackets comprise a frame, a mounting base and structure for pressing the guide rail against the mounting base, which guide rail bracket essentially prevents at its point lateral movement of the guide rail in relation to the fixing point of the guide rail bracket and permits longitudinal movement of the guide rail in relation to the fixing point of the guide rail bracket. The aforementioned mounting base is fixed to the frame of the guide rail bracket movably in the longitudinal direction of the guide rail.

39 Claims, 5 Drawing Sheets

ELEVATOR AND GUIDE RAIL BRACKET

CROSS-REFERENCE TO RELATED APPLICATIONS

Figure 1:
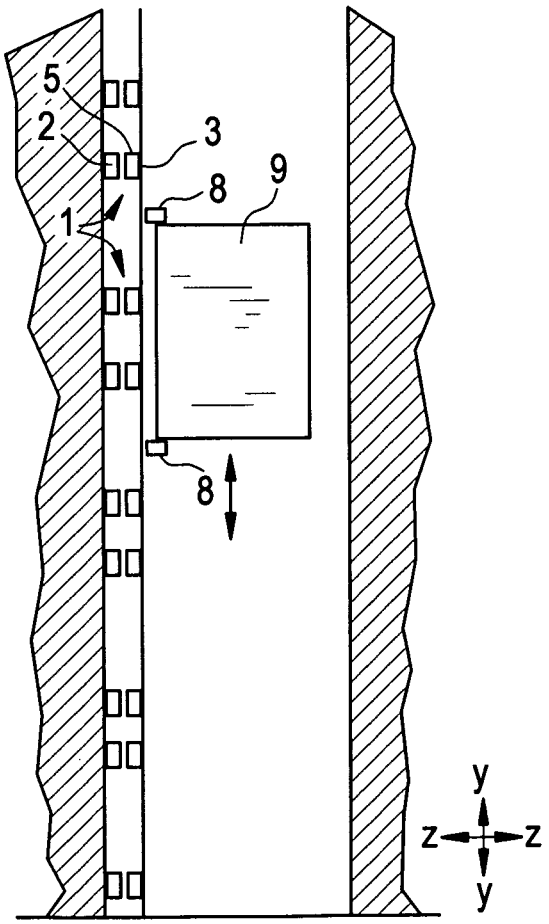

This is a Continuation of PCT/FI2010/051081 filed on Dec. 22, 2010 which is an International Application claiming priority from FI 20090502 filed on Dec. 22, 2009, and FI 20100041 filed on Feb. 4, 2010; the entire contents of each of which are hereby incorporated by reference.

FIELD OF THE INVENTION

The object of the invention is an elevator, a guide rail bracket of an elevator, a support arrangement of a guide rail of an elevator and a method for manufacturing a guide rail bracket of an elevator.

BACKGROUND OF THE INVENTION

The guide rails of an elevator, such as the car guide rails or counterweight guide rails, are generally fixed in position by stacking elongated guide rails to be supported by each other in the vertical direction and by supporting them in the lateral direction to be immovable on the building with guide rail brackets, which aim to permit longitudinal movement of a guide rail in relation to the building. A guide rail must be able to move in relation to the building because the dimensional changes of a long guide rail line and of the building in relation to time are different. After the construction phase the drying of concrete, in particular, results in shrinking of the building, a consequence of which can be compression of the guide rail line into a curve if the guide rails of the guide rail line are not able to move in relation to the building. This relative movement is in prior art arranged to occur e.g. with sliding between a guide rail bracket rigidly fixed to the building and the guide rail. In these types of solutions the guide rail clamp of the guide rail bracket presses the guide rail against the base comprised in the guide rail bracket. A problem of this solution is that the thickness tolerances of the guide rails are large and the compression force exerted by the guide rail clamp on the guide rail might form to be too great, preventing sliding between the guide rail and the clamp. More specifically, when a thick point of the guide rail slides to the point of the guide rail clamp, the structure of the guide rail clamp does not always give way sufficiently and as a result of this it presses the guide rail against the base with too great a force. A consequence of this can be bulging of the guide rail line as the guide rails are compressed into a curve.

AIM OF THE INVENTION

The aim of the invention is to produce a better elevator than earlier with respect to the fixing of the guide rails. The aim of the invention is to eliminate the aforementioned drawbacks, among others, of prior-art solutions. The aim of the invention is further to produce one or more of the following advantages, among others:

- An elevator is achieved, the large manufacturing tolerances of the guide rails or guide rail bracket of which cause less problems than earlier.
- An elevator with inexpensive manufacturing costs is achieved.
- An elevator is achieved that retains drive comfort well.
- A safe elevator is achieved.

These advantages are achieved with the solutions according to the invention.

SUMMARY OF THE INVENTION

The first aspect of the invention is based on a concept that movability of the guide rail and of the building in relation to each other can be arranged such that the guide rail is fixed against the mounting base in relation to the mounting base (at least essentially) immovably, which mounting base is fixed to the building movably in the longitudinal direction of the guide rail. Thus the fixing between the guide rail and the element that is immovable in relation to the guide rail is not that fixing that primarily enables movement between the guide rail and the building, but instead the aforementioned movement is enabled by movability between the aforementioned element (mounting base) and the building. In this case variations in the shape and thickness of a guide rail do not affect the movability, because this movability is achieved with the invention with the movement of two such elements in relation to each other, neither of which is a guide rail, but instead an element that is easily manufacturable to precise dimensions. From this it follows that the movability of the guide rail in relation to the building is more reliable than earlier. In the following some embodiments of the first aspect will be generally presented.

In a basic embodiment of the concept according to the invention the elevator comprises a guide rail line, which comprises a plurality of consecutive guide rails, which are supported on the building with guide rail brackets fixed to the building, which guide rail brackets comprise a frame, a mounting base and means for pressing the guide rail against the mounting base, which guide rail bracket essentially prevents at its point lateral movement of the guide rail in relation to the fixing point of the guide rail bracket and permits longitudinal movement of the guide rail in relation to the fixing point of the guide rail bracket. The aforementioned mounting base is fixed to the frame of the guide rail bracket movably in the longitudinal direction of the guide rail. With this embodiment the aforementioned advantages are achieved simply.

In a more refined embodiment of the concept according to the invention the aforementioned movability is achieved by arranging the mounting base to move in relation to the frame by sliding following the frame. Thus movability is simple to implement to occur without shape deformation.

In a more refined embodiment of the concept according to the invention the means for pressing the guide rail against the mounting base essentially (preferably completely) prevent movement between the mounting base and the guide rail. Thus the movement can be restricted to occur only in essential points.

In a more refined embodiment of the concept according to the invention the frame is fixed rigidly to the building. Thus the movement can be restricted to occur only in essential points.

In a more refined embodiment of the concept according to the invention a guide rail bracket comprises guide means which are arranged to guide the movement between the mounting base and the frame in the longitudinal direction of the guide rail, preferably to guide the aforementioned movement to occur only in the longitudinal direction of the guide rail. Thus relative movability is achieved simply. Relative movement, i.e. a shift between the elements without shape deformation, can be simply implemented in this way simply based on the elements sliding along each other.

In a more refined embodiment of the concept according to the invention the mounting base is fixed to the frame to be supported against the frame and the guide rail is fixed to the mounting base to be supported against the mounting base and that the fixing between the guide rail and the mounting base resists relative movement in the longitudinal direction of the guide rail between the guide rail and the mounting base with a greater force, which force is preferably produced from friction between the mounting base and the guide rail and/or from shape-locking, than the force with which the fixing between the mounting base and the frame resists relative movement in the longitudinal direction of the guide rail between the mounting base and the frame, which force is preferably produced from friction resulting from the fixing between the mounting base and the frame. Thus the movement is primarily an internal movement of the guide rail bracket, and the guide rail remains firmly against its base, in which case the point of occurrence of the movement is easy to determine and the movement in itself is easy to control.

In a more refined embodiment of the concept according to the invention the means for pressing the guide rail against the mounting base press the guide rail against the mounting base and the mounting base against the frame such that the first normal force between the guide rail and the mounting base is essentially greater than the second normal force between the mounting base and the frame, which second normal force is preferably essentially zero. By adjusting the friction forces the relative movement is simple to target to occur primarily as an internal movement of the guide rail bracket.

In a more refined embodiment of the concept according to the invention the mounting base is fixed to the frame of the guide rail bracket movably in the longitudinal direction of the guide rail, which movement is a shift between the mounting base and the frame at least essentially without shape deformation of the frame or of the mounting base, preferably completely without shape deformation. Thus the guide rail line remains reliably and rigidly in line and the runbys of the car do not fatigue the bracket structure significantly, and the solution is long-lasting.

In a more refined embodiment of the concept according to the invention the guide means comprise a guide and a guide piece that travels guided by the guide and that (directly or indirectly) guides the guide rail. Thus relative movement is simple to implement.

In a more refined embodiment of the concept according to the invention the frame comprises the aforementioned guide and the aforementioned guide piece is a part of the mounting base or is at least supported to move along with the mounting base and arranged to transmit lateral support force from the guide directly or indirectly to the mounting base and/or to the guide rail. Thus relative movement is simple to restrict to occur only as longitudinal to the guide rail.

In a more refined embodiment of the concept according to the invention the mounting base is fixed to the frame of the guide rail bracket movably in the longitudinal direction of the guide rail against the vertical guide surface comprised in the frame, following which and guided by which guide surface the mounting base is arranged to move in the longitudinal direction of the guide rail. Thus movability is simple to implement to occur without shape deformation and to restrict the movement to occur only as longitudinal to the guide rail.

In a more refined embodiment of the concept according to the invention the guide surface and/or the surface to be placed against the guide surface of the mounting base is treated with a surface treatment that reduces friction, preferably by coating the surface with a material that reduces friction and/or by polishing the surface. Thus relative movability can be ensured simply. The coating presented (e.g. with Teflon) can form a separate invention independent of the other features presented in the preceding.

In a more refined embodiment of the concept according to the invention the mounting base is supported against the guide surface of the frame by pressing it and the fixing element, such as e.g. a washer or a nut, on the opposite side of the frame towards each other with an element of the frame extending through the frame. Thus guidance/support forces in the longitudinal direction of the fixing element are achieved simply.

In a more refined embodiment of the concept according to the invention the aforementioned element travels through the guide groove comprised in the frame, and is preferably a bolt, and preferably transmits directly or indirectly the guidance of the guide groove to the mounting base and/or to the guide rail. Thus with few components guidance/support forces in both the transverse directions z and x can be achieved.

In a more refined embodiment of the concept according to the invention the guide surface of the mounting base is supported against the guide surface of the frame by pressing it and the element, such as e.g. a washer or a nut, comprising a guide surface on the opposite side of the frame towards each other e.g. with an element of the frame extending through the frame, and that the guide rail bracket comprises members (21, 61) for keeping the element comprising the guide surface of the guide rail and the element comprising the guide surface 41 at a distance from each other, for keeping the guide surfaces of them at a distance from each other.

In a more refined embodiment of the concept according to the invention the aforementioned members (21, 61) for keeping the element comprising the guide surface of the guide rail and the element comprising the guide surface 41 at a distance from each other comprises a guide piece, which alone, or together with a possible clearance adjusting member 61, mechanically prevents the guide surfaces that face each other from being compressed to below a certain distance from each other. Thus the force of compression to be transmitted to the frame can be limited simply. At the same time guidance can be formed with few components. More particularly in this case the distance from each other of the guide surfaces that are on opposite sides of the frame and that are in connection with the guide rail can be accurately regulated to be suitable, because in this way the effect of tolerance variations occurring in the thickness of the frame can be eliminated. The elimination of the effect of tolerances in the manner described is particularly advantageous when the aim is to achieve very small clearances.

In a more refined embodiment of the concept according to the invention the guide surface of the mounting base is supported against the guide surface of the frame by pressing it and the element comprising a guide surface on the opposite side of the frame towards each other, and between the mounting base and the fixing element 40 is a guide piece and a thin clearance adjusting member, such as a shim plate (e.g. a washer) stacked in the direction of the compression, which guide piece and clearance adjusting member together mechanically prevent the guide surfaces that face each other from being compressed to below a certain distance from each other. Thus the mounting base and the fixing element can be kept apart from each other. In this case the guide piece preferably essentially corresponds in its material thickness to the thickness of the frame, preferably fully corresponds to the thickness of the frame. The thickness of the frame refers to the thickness between the guide surfaces facing opposite sides of the frame.

In a more refined embodiment of the concept according to the invention the guide surface of the mounting base is supported against the guide surface of the frame by pressing the mounting base and the element, such as e.g. a washer or a nut, comprising a guide surface on the opposite side of the frame towards each other by pressing them against a guide piece (and a possible clearance adjusting member) between the mounting base and the fixing element 40, and that the guide piece essentially corresponds in its material thickness (in the direction of the compression) to the thickness of the frame, preferably fully corresponds to the thickness of the frame. Thus it can be ensured simply that relative movement is not prevented owing to excessive friction. Namely, the guide piece thus bears the compression of the mounting base and of the fixing element 40 and limits the friction resulting from the fixing between the mounting base and the frame.

In a more refined embodiment of the concept according to the invention the guide piece is a bushing, preferably plate-type, such as a washer. The guide piece is preferably of metal. The aforementioned element that extends through the frame preferably travels through the guide piece.

In a more refined embodiment of the concept according to the invention the guide piece is cut from a piece that is of integral material with the frame, from the proximity of the guide groove. Thus a guide piece of precisely the correct thickness is obtained. Cutting the guide piece from the plate comprising the guide groove, from near the guide groove, can form a separate invention independent of the other features presented in the preceding.

In a more refined embodiment of the concept according to the invention the guide piece is cut from the frame from a point comprising a guide surface. Thus a guide piece of precisely the correct thickness is obtained. Cutting the guide piece from the plate comprising the guide groove at the point of the guide groove, or at least near it, can form a separate invention independent of the other features presented in the preceding.

In a more refined embodiment of the concept according to the invention the mounting base is a plate. Thus a simple structure is achieved.

In a more refined embodiment of the concept according to the invention the frame comprises a frame part, preferably a plate, which frame part comprises

- a guide slot, which is arranged to guide the guide piece that travels in the guide slot, which guide piece is arranged to transmit support force to the guide rail and/or to the mounting base from the guide groove in the first horizontal direction x, and
- surfaces facing opposite directions, which surfaces are guide surfaces and arranged to guide the guide surfaces supported on them of the elements supported on the guide rail that are, which guide surfaces are arranged to transmit support force in the second horizontal direction z to the guide rail and/or to the mounting base.

Thus with few components guidance/support forces in both the transverse directions z and x can be achieved.

In a basic embodiment of the concept according to the invention the guide rail bracket for supporting the guide rail on the building comprises a frame, a mounting base, and also means for pressing the guide rail against the mounting base and for fixing the mounting base to the frame of the guide rail bracket movably in the longitudinal direction of the guide rail. With the guide rail bracket and with the following embodiments of it the corresponding advantages already mentioned are achieved.

In a more refined embodiment of the concept according to the invention the aforementioned movability is achieved by arranging the mounting base to move in relation to the frame by sliding following the frame. Thus movability is simple to implement to occur without shape deformation.

In a more refined embodiment of the concept according to the invention the guide surface and/or the surface to be placed against the guide surface of the mounting base is treated with a surface treatment that reduces friction, preferably by coating the surface with a material that reduces friction and/or by polishing the surface.

In a more refined embodiment of the concept according to the invention the mounting base is supported against the guide surface of the frame by pressing it and the fixing element, such as e.g. a washer or a nut, on the opposite side of the frame towards each other with an element of the frame extending through the frame.

In a more refined embodiment of the concept according to the invention the guide rail bracket comprises members (21, 61) for limiting the compression between the mounting base and the frame.

In a more refined embodiment of the concept according to the invention the aforementioned element travels through the guide groove comprised in the frame, and is preferably a bolt, and preferably transmits directly or indirectly the guidance of the guide groove to the mounting base and/or to the guide rail.

In a more refined embodiment of the concept according to the invention the mounting base is arranged to be supported against the guide surface of the frame by pressing the mounting base and the fixing element, such as e.g. a washer or a nut, on the opposite side of the frame towards each other by pressing them against a guide piece, and a possible clearance adjusting member 61, between the mounting base and the fixing element.

In a more refined embodiment of the concept according to the invention the guide piece essentially corresponds in its material thickness to the thickness of the frame, preferably fully corresponds to the thickness of the frame.

In a more refined embodiment of the concept according to the invention the guide piece is cut from a piece that is of integral material with the frame, from the proximity of the guide groove.

In a more refined embodiment of the concept according to the invention the guide piece is cut from the frame from a point comprising a guide surface.

In a more refined embodiment of the concept according to the invention the mounting base is a plate.

In a more refined embodiment of the concept according to the invention a guide rail bracket comprises guide means which are arranged to guide the movement between the mounting base and the frame in the longitudinal direction of the guide rail, preferably to guide the aforementioned movement to occur only in the longitudinal direction of the guide rail.

In a more refined embodiment of the concept according to the invention the frame comprises a frame part, preferably a plate, which frame part comprises

- a guide slot for guiding the guide piece that travels in the guide slot, which guide piece transmits support force to the guide rail and/or to the mounting base from the guide groove in the first horizontal direction x, and
- surfaces facing opposite directions, which surfaces form guide surfaces for the guide surfaces supported on them, which guide surfaces transmit support force in the second horizontal direction z to the guide rail and/or to the mounting base.

A guide rail bracket can further comprise other features presented in connection with the aforementioned elevator, with which features corresponding advantages can be achieved.

The second aspect of the invention is based on a concept that the frame can be arranged to comprise guide surfaces, which are arranged to guide the guide surfaces that are in connection with the guide rail and take the support force needed for the guidance from the guide surfaces of the frame that are between them. Further, according to the concept the guide surfaces that are in connection with the guide rail are kept at a distance from each other. Thus movability with relation to each other of the guide surfaces of the guide rail and the guide surfaces of the frame in the longitudinal direction is ensured. From this it follows that the movability of the guide rail in relation to the building is more reliable than earlier. In the following some embodiments of this second aspect will be generally presented.

In a basic embodiment of the concept according to the invention support arrangement of a guide rail of an elevator, in which arrangement the guide rail is supported on the frame of a guide rail bracket supported on the building movably in relation to the frame in the longitudinal direction of the guide rail, the frame of the guide rail bracket comprises guide surfaces that face opposite sides of the frame, and that in the arrangement on the opposite sides of the frame there are guide surfaces that are pressed towards each other and are in connection with the guide rail, which guide surfaces are fitted for guiding the aforementioned guide surfaces of the frame and to transmit support force in the direction of the compression from the frame to the guide rail, and that the arrangement comprises means for keeping the aforementioned guide surfaces of the guide rail at a distance from each other in the direction of the compression. With this embodiment the aforementioned advantages are achieved simply. The transmission of compression to the frame can be limited, so that the friction between the guide surfaces remains small.

In a more refined embodiment of the concept according to the invention the means bear the aforementioned compression and limit the transmission of the compression, at least in its entirety, to the guide surfaces of the frame that are between the guide surfaces that are in connection with the guide rail. The transmission of compression to the frame can thus be advantageously limited.

In a more refined embodiment of the concept according to the invention the means comprise a means/means between the elements comprising the guide surfaces connected to the guide rail, which means mechanically prevent/prevents the means comprising the guide surfaces connected to the guide rail from being compressed to below a certain distance from each other. The transmission of compression to the frame can thus be advantageously limited.

In a more refined embodiment of the concept according to the invention the aforementioned means comprise a member (guide piece 21) between the elements comprising the guide surfaces connected to the guide rail, the thickness of which member (guide piece 21) corresponds to the thickness of the frame in the direction of the compression. Thus the means bears the compression, preventing its detrimental transmission to the frame.

More particularly in this case the distance from each other of the guide surfaces that are on opposite sides of the frame and that are in connection with the guide rail can be accurately regulated to be suitable, because in this way the effect of tolerance variations occurring in the thickness of the frame can be eliminated. If a clearance adjusting member is stacked together with the aforementioned means that is the thickness of the frame between the elements comprising the guide surfaces that are in connection with the guide rail, a clearance that is precisely the magnitude of the clearance adjusting member, is formed between the guide surfaces of the frame and the guide surfaces that are in connection with the guide rail, irrespective of the thickness of the frame. If a clearance adjusting member is not used the clearance is zero, but compression is essentially not exerted on the frame. It is advantageous, however, if the clearance is formed to be very small, preferably at most 0.5 mm in magnitude, in which case vertical relative movement is ensured and nevertheless disturbing horizontal relative movement does not occur. The elimination of the effect of tolerances in the manner described is particularly advantageous when the aim is to achieve very small clearances.

In a more refined embodiment of the concept according to the invention the aforementioned means comprise a member (guide piece 21) stacked in the direction of the compression between the elements comprising guide surfaces that are in connection with the guide rail, the thickness of which member (guide piece 21) corresponds to the thickness of the frame in the direction of the compression, and also at least one clearance adjusting member, which together keep the guide surfaces at a distance from each other, which distance is the thickness of the aforementioned member (guide piece 21)+ the thickness of at least one aforementioned clearance adjusting member. With the regulating means the clearance between the stationary frame 2 and the guide surfaces that are on opposite sides of the frame, move in relation to the frame and are in connection with the guide rail can be controlled. In this way the aforementioned advantages are achieved.

In a more refined embodiment of the concept according to the invention the aforementioned direction (z) of the compression is the first horizontal direction and the arrangement also comprises guide means (11,21), which transmit support force from the frame to the guide rail in the second horizontal direction (x), which is at a right angle in relation to the first horizontal direction. Thus the guide rail can be guided effectively in both horizontal directions with the same guide rail bracket.

In a more refined embodiment of the concept according to the invention the aforementioned member (guide piece 21) between the elements comprising the guide surfaces connected to the guide rail is a guide piece, which at the same time functions as a guide piece traveling in the guide comprised in the frame, and transmits support force from the frame to the guide rail (3) in the second horizontal direction (x). In this way a simple and compact solution is achieved.

In a more refined embodiment of the concept according to the invention the guide means (11, 21) for transmitting support force from the frame to the guide rail in the second horizontal direction (x) comprise an elongated guide (11) and a guide piece traveling guided by the guide (11), which guide piece is preferably connected to the guide rail (3) such that it can transmit support force from the guide (11) in the direction (x) to the guide rail (3). The guide piece thus moves along with the guide rail. The solution can be implemented simply and compactly.

In a more refined embodiment of the concept according to the invention at least the second of the elements comprising a guide surface that is in connection with the guide rail is connected to the actual guide rail by fixing it with fixing means to the guide rail. The guide rail itself is thus simple in its structure when the frame can be fitted between the guide rail 3 and the element that is on the rear side of the frame and connected to the guide rail.

In a more refined embodiment of the concept according to the invention the frame comprises a frame part, preferably a plate, which frame part comprises a guide slot for guiding the guide piece that travels in the guide slot and that is connected to the guide rail, which guide piece transmits support force to the guide rail from the guide groove in the first horizontal direction (x), and the aforementioned guide surfaces facing opposite sides of the frame, which guide surfaces transmit support force in the second horizontal direction (Z) to the guide rail.

In a more refined embodiment of the concept according to the invention at least a part of the guide surfaces are treated with a surface treatment that reduces friction, preferably by coating the surface with a material that reduces friction and/or by polishing the surface. Thus relative movability can be ensured simply. The coating described (e.g. with Teflon) can form a separate invention independent of the other features presented in the preceding.

In a more refined embodiment of the concept according to the invention the arrangement comprises a mounting base between the guide rail and the guide surface of the frame, which mounting base comprises the aforementioned guide surface, which guide surface faces towards the guide surface of the frame. Thus the guide surface can be formed to be separate from the guide rail and the guide surface is easy to surface-treat or to form into an advantageous size.

In a more refined embodiment of the concept according to the invention the guide surfaces that are in connection with the guide rail are pressed towards each other by the aid of a means traveling via the hole extending through the guide rail 3, preferably with a bolt and with a nut on the threaded end of the bolt. The solution is thus simple.

In a more refined embodiment of the concept according to the invention the means is a bolt, and the hole is a round hole made in the guide rail preferably by drilling. Thus the relative movement between the guide rail and the bolt is easy to prevent and manufacturing of the structure is simple.

In a more refined embodiment of the concept according to the invention the means is a bolt, and the hole prevents relative movement between the bolt and the guide rail at least in the longitudinal direction of the guide rail. Thus the solution is reliable, safe and simple. The bolt also moves along with the guide rail reliably.

In a basic embodiment of the concept according to the invention the elevator comprises at least an elevator car, a guide rail line for guiding the movable elevator unit, such as the aforementioned elevator car or a possible counterweight, which guide rail line comprises a plurality of consecutive guide rails, which are supported on the building with any support arrangement of the guide rail of an elevator specified earlier herein. Thus an elevator is achieved, the movability of the guide rail of which is good in the longitudinal direction and which elevator can be implemented with simple arrangements.

In a basic embodiment of the concept according to the invention the guide rail bracket for supporting the guide rail on the building comprises a frame and means for fixing the frame immovably to the building. The frame of the guide rail bracket comprises guide surfaces that face opposite sides of the frame, and the guide rail bracket comprises means for pressing the guide surfaces that are placed on different sides of the frame and are in connection with the guide rail towards each other and towards the guide surfaces of the frame, for fitting the guide surfaces of the guide rail to be guided by the aforementioned guide surfaces of the frame, and members (21, 61) for keeping the guide surfaces that are in connection with the guide rail at a distance from each other in the direction of the compression. In this way a simple guide rail bracket is achieved that ensures good movability for the guide rail. With respect to the advantages of the embodiments of the guide rail bracket, reference is made to the advantages, described elsewhere in this patent application, of the corresponding features.

In a more refined embodiment of the concept according to the invention the members (21, 61) of the guide rail bracket can be fitted to bear the aforementioned compression and to limit the transmission of the compression, at least in its entirety, to the guide surfaces of the frame that are between the guide surfaces that are in connection with the guide rail.

In a more refined embodiment of the concept according to the invention the members (21, 61) comprise a means/means to be fitted between the elements comprising the guide surfaces connected to the guide rail, which means mechanically prevent/prevents the elements comprising the guide surfaces connected to the guide rail from being compressed to below a certain distance from each other.

In a more refined embodiment of the concept according to the invention the aforementioned means comprise a member (guide piece 21) that can be fitted between the elements comprising the guide surfaces connected to the guide rail, the thickness of which member (guide piece 21) corresponds to the thickness of the frame in the direction of the compression.

In a more refined embodiment of the concept according to the invention the aforementioned means comprise a member (guide piece 21) to be stacked in the direction of the compression between the elements comprising guide surfaces that are in connection with the guide rail, the thickness of which member (guide piece 21) corresponds to the thickness of the frame in the direction of the compression, and also at least one clearance adjusting member, which together keep the guide surfaces at a distance from each other, which distance is the thickness of the aforementioned member (guide piece 21)+ the thickness of at least one aforementioned clearance adjusting member.

In a more refined embodiment of the concept according to the invention the aforementioned direction of the compression (z) is the first horizontal direction and the guide rail bracket also comprises guide means, which transmit support force from the frame to the guide rail in the second horizontal direction (x), which is at a right angle in relation to the first horizontal direction.

In a more refined embodiment of the concept according to the invention the aforementioned means between the elements comprising the guide surfaces connected to the guide rail is a guide piece, which at the same time functions as a guide piece traveling in the guide comprised in the frame, for transmitting support force from the frame to the guide rail in the second horizontal direction (x).

In a more refined embodiment of the concept according to the invention the guide means for transmitting support force from the frame to the guide rail in the second horizontal direction (x) comprise an elongated guide comprised in the frame and a guide piece traveling guided by the guide, which guide piece can preferably be connected to the guide rail (3) such that it can move along with the guide rail and transmit support force from the guide in the direction (x) to the guide rail.

In a more refined embodiment of the concept according to the invention the frame comprises a frame part, preferably a plate, which frame part comprises a guide slot for guiding the guide piece that travels in the guide slot and that is connected to the guide rail, which guide piece transmits support force to the guide rail from the guide groove in the first horizontal direction (x), and the aforementioned guide surfaces facing opposite sides of the frame, which guide surfaces transmit support force in the second horizontal direction (Z) to the guide rail.

In a more refined embodiment of the concept according to the invention at least a part of the guide surfaces are treated with a surface treatment that reduces friction, preferably by coating the surface with a material that reduces friction and/or by polishing the surface.

For implementing the aspects of the invention, a method for manufacturing a guide rail bracket of an elevator is also disclosed, in the basic embodiment of which method the frame part of the guide rail bracket is manufactured from plate, preferably from metal plate. In the method an elongated guide slot is machined in the frame part, which guide slot is an elongated hole extending through the frame part, the side walls of which guide slot form longitudinal guide surfaces of the guide slot for guiding the guide piece traveling in the guide slot, and a guide piece is manufactured, and that means are provided for fixing the guide rail to be guided by the guide piece and by the guide slot.

In a more refined embodiment of the method the guide piece is manufactured to correspond in its material thickness to the material thickness of the frame part comprising the guide slot.

In a more refined embodiment of the concept according to the invention the guide piece is manufactured by cutting it from a plate that is of integral material with the frame part, preferably from the proximity of a guide slot.

In all the embodiments described above the clearance adjusting member is preferably a shim plate, preferably a washer. The aforementioned element that extends through the frame preferably travels through the clearance adjusting member.

In all the embodiments described above the clearance adjusting member is preferably a shim plate and is (in the direction of its compression) 0.1-0.5 mm, most preferably 0.2-0.4 mm, in its material thickness. When the thickness of the guide piece corresponds to the thickness of the frame, the thickness of the regulating means sets the clearance between the stationary frame and the mounting base and fixing element 40 that move in relation to it. Thus the clearance is easy to adjust to that desired.

In all the embodiments described above the member (guide piece 21) is preferably a bushing, more preferably a plate-type bushing, such as a washer, and most preferably of metal. The solution is thus simple.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments. Each embodiment can also singly and separately from the other embodiments form a separate invention.

LIST OF FIGURES

In the following, the invention will be described in detail by the aid of some examples of its embodiments with reference to the attached drawings, wherein FIG. 1 presents by way of reference a first embodiment of an elevator according to the invention as viewed from the side.

Figure 2:
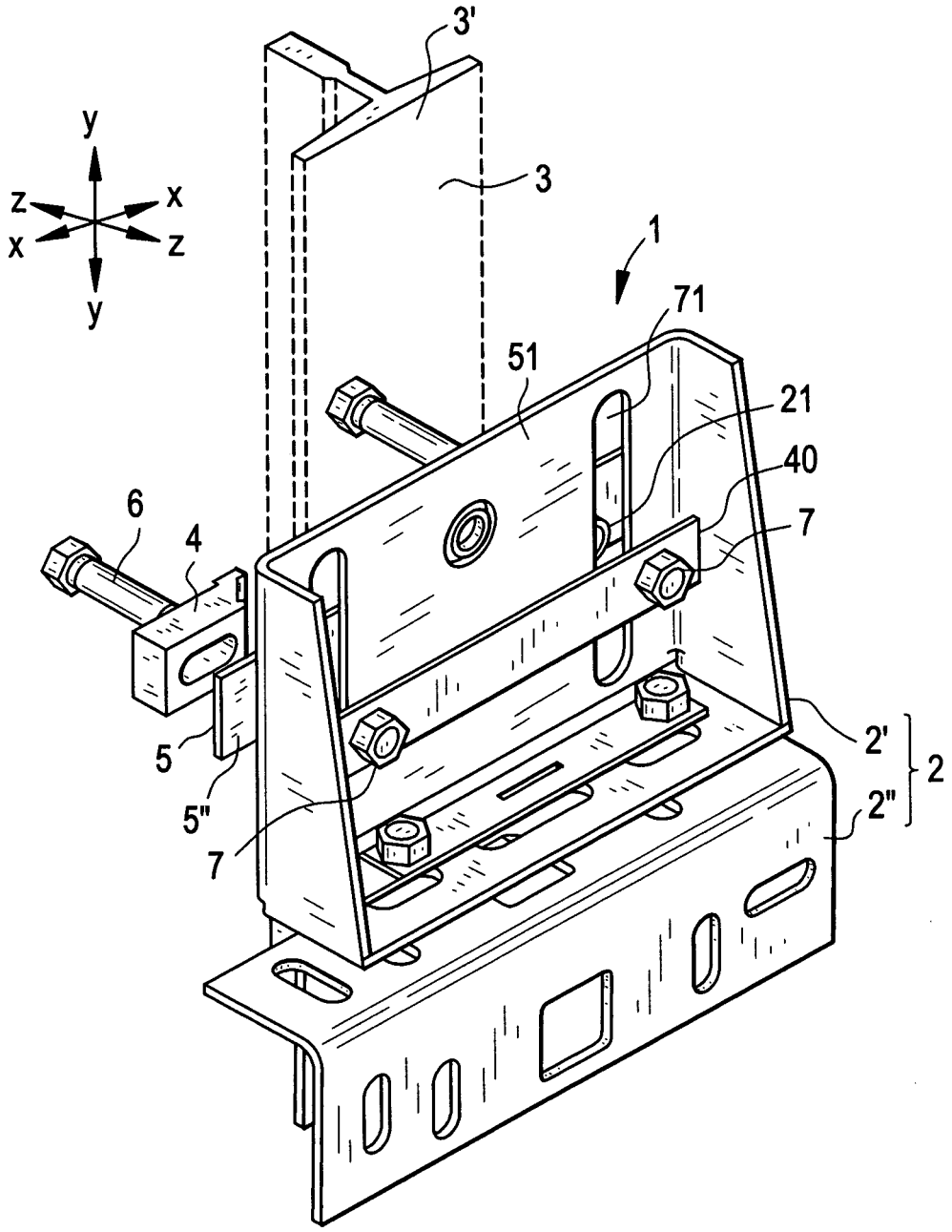
Figure 3:
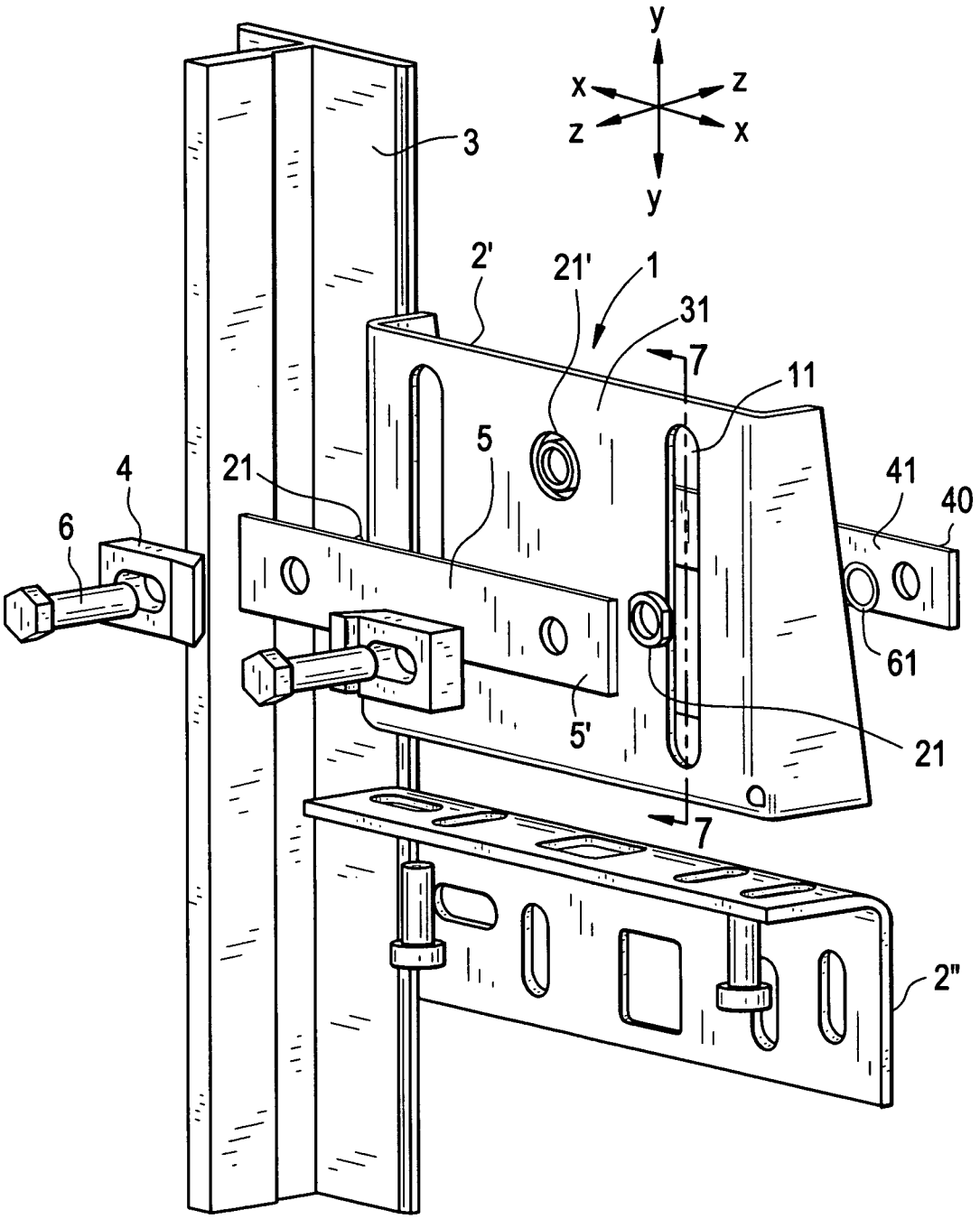

FIGS. 2-3 present a three-dimensional drawing of an arrangement and a guide rail bracket according to the first embodiment of the invention, and a preferred method to implement the elevator of FIG. 1.

Figure 4:
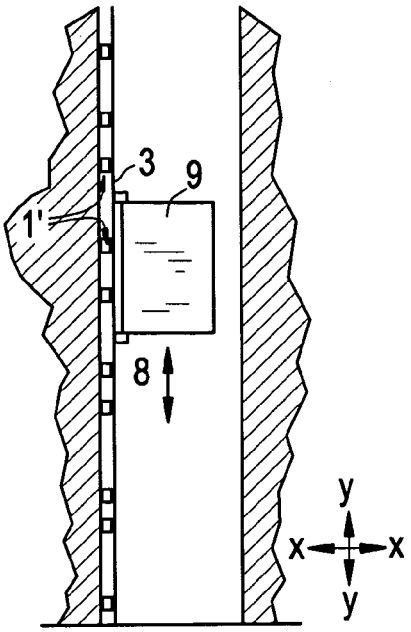

FIG. 4 presents by way of reference an elevator according to a second embodiment of the invention, as viewed from the side.

Figure 5:
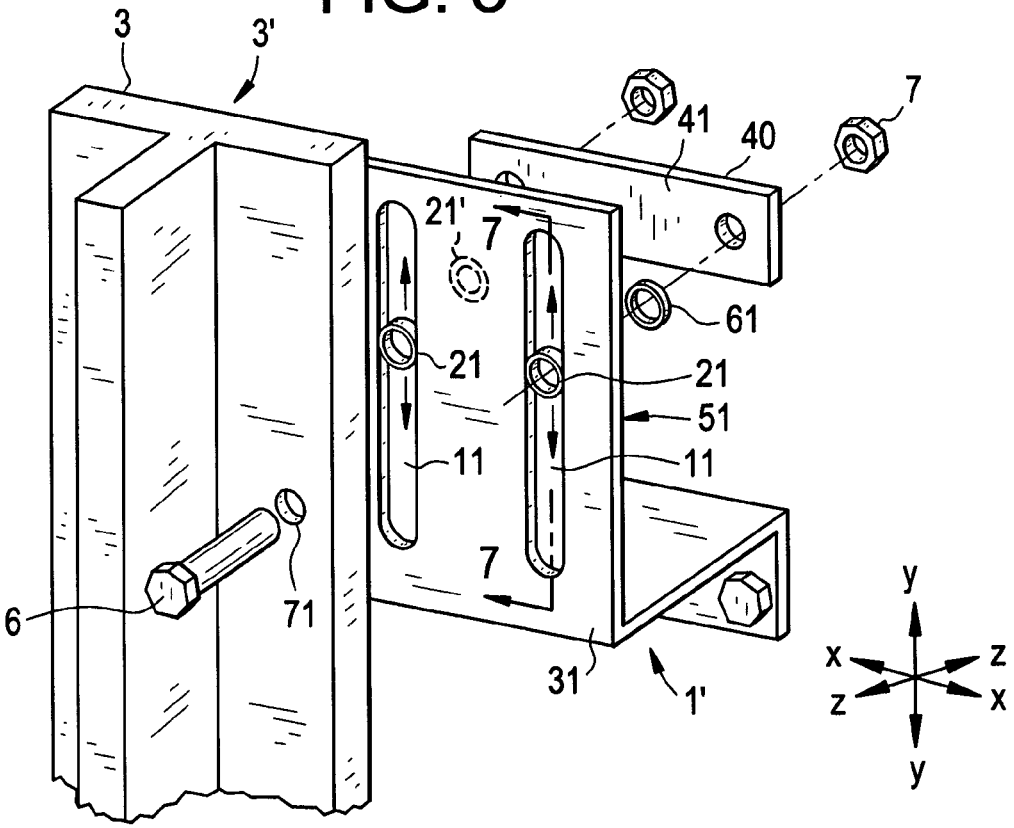

FIG. 5 presents a three-dimensional drawing of an arrangement and a guide rail bracket according to the second embodiment of the invention, and a preferred method to implement the elevator of FIG. 1.

Figure 6:
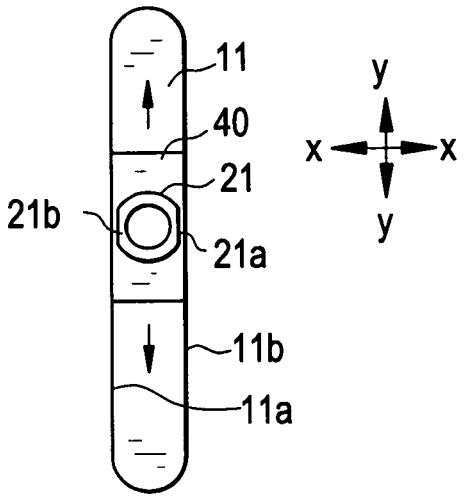

FIG. 6 presents a detail of FIGS. 3 and 4 as viewed from the direction of the guide rail.

Figure 7:
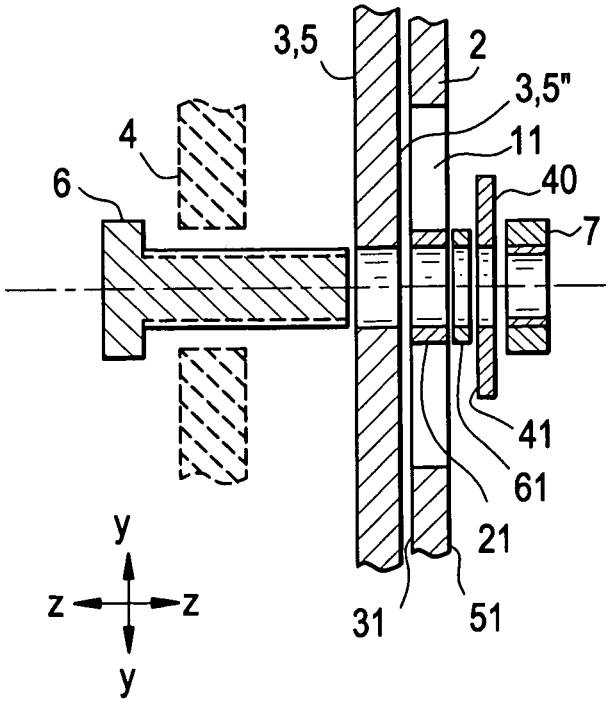

FIG. 7 presents the section 7-7 from FIG. 3 or 4.

DETAILED DESCRIPTION OF THE INVENTION

FIG. 1 presents an elevator according to the first embodiment of the invention, which elevator comprises a guide rail line, which comprises a plurality of consecutive guide rails 3, which are supported on the building with guide rail brackets 1 fixed to the building. The guide rails 3 of the guide rail line guide the elevator unit 9 moving in the elevator hoistway, which elevator unit is an elevator car for moving passengers, or a counterweight, via guide shoes 9 traveling following the guide rails on the aforementioned elevator unit. The guide rail brackets 1 comprise a frame 2, a mounting base 5 and means (4,6,7,40) for pressing the guide rail 3 against the mounting base 5, which guide rail bracket 1 essentially prevents at its point lateral movement of the guide rail 3 in relation to the fixing point of the guide rail bracket 1 (the point of the building to which the guide rail bracket is fixed), and permits longitudinal movement of the guide rail in relation to the fixing point of the guide rail bracket 1. The means for pressing the guide rail against the mounting base essentially (preferably completely) prevent movement between the mounting base 5 and the guide rail 3. The aforementioned mounting base 5 is fixed to the frame 2 of the guide rail bracket 1 movably in the longitudinal direction of the guide rail 3, which frame 2 is fixed immovably to the building. Thus the movement between the guide rail and the building can be arranged to occur as a movement between the frame 2 and the mounting base instead of a movement between the mounting base and the guide rail.

FIGS. 2-3 present in more detail an embodiment of a guide rail bracket according to the invention and a preferred method to implement the elevator of FIG. 1. In the figures the frame 2 is of two parts and comprises an actual part 2' that is against the guide rail and a part 2" for fixing the part 2' adjustably and rigidly to the building. The parts 2' and 2" are arranged to be fixed rigidly to each other. The frame 2 could, however, alternatively be one integral piece.

The means (4,6,7,40) that press the guide rail against the mounting base also fix the mounting base movably to the frame 2. The guide rail bracket 1 comprises guide means (5",11,21,31,41,51) which are arranged to guide the movement between the mounting base 5 and the frame 2 in the longitudinal direction of the guide rail 3. The guide means comprise a guide 11 comprised in the frame 2 and a guide piece 21 guiding the guide rail 3 traveling guided by the guide 11, which guide piece as presented is supported to move along with the mounting base when the mounting base moves in the longitudinal direction of the guide rail. The guide is an elongated guide slot 11 (presented as an elongated hole extending through the frame 2), which guide slot is arranged to guide the guide piece that travels in the guide slot, which guide piece is arranged to transmit lateral support force (in the first horizontal direction x) from the guide 11 to the mounting base 5 and to the guide rail 3. This support force prevents the guide rail 3 from moving in the aforementioned direction in relation to the frame 2. The guide piece 21 is preferably a separate part, but it could alternatively be a part of the mounting base 5. The mounting base 5 is fixed to the frame 2 of the guide rail bracket 1 movably in the longitudinal direction of the guide rail 3 against the vertical guide surface 31 comprised in the frame 2, following which and guided by which guide surface the mounting base 5 is arranged to move in the longitudinal direction of the guide rail 3. The frame 2 comprises surfaces (31 and 51) facing opposite directions, which surfaces (31 and 51) are guide surfaces and arranged to guide the guide surfaces (5" and 41) supported on them of the elements (mounting base 5 and washer 40) supported on the guide rail 3, which guide surfaces (5" and 41) are arranged to transmit in the second horizontal direction (z) support force to the guide rail and/or to the mounting base.

The mounting base 5 is a plate, which is fixed to the frame 2 such that it rests against the frame 2, and the guide rail 3 is fixed to the mounting base 5 such that it rests against the mounting base 5. The fixing between the guide rail 3 and the mounting base 5 is arranged to resist relative movement in the longitudinal direction of the guide rail 3 between the guide rail 3 and the mounting base 5 with a greater force, than the force with which the fixing between the mounting base and the frame resists relative movement in the longitudinal direction of the guide rail between the mounting base and the frame, which force is preferably produced from friction between the mounting base and the frame. In the solution presented in the figure the guide rail is fixed with friction immovably with the mounting base, but this could additionally or alternatively be done (without guide rail clamps) also by shape-locking, such that the bolt 6 of the figure travels through the hole made in the guide rail 3 and the hole 70 of the mounting base 5. In the shape-locking alternative, the compression force between the mounting base and the guide rail is insignificant from the perspective of the longitudinal movement of the guide rail. In the case of a friction fixing between the guide rail and the mounting base, the means (4,6,7,40) for pressing the guide rail 3 against the mounting base 5 press the guide rail (the back surface 3' of the guide rail) against the countersurface 5' of the mounting base and the mounting base against the frame such that the first normal force between the guide rail and the mounting base is essentially greater than the second normal force between the mounting base and the frame, which second normal force is preferably essentially zero (limited by the part 21). By adjusting the friction forces the relative movement is simple to target to occur primarily as an internal movement of the guide rail bracket.

The friction force between the mounting base and the frame 2 is in the invention kept low such that the guide surface 5" is supported against the guide surface 31 of the frame 2 by pressing it and the element 40, which as presented is a washer 40, comprising the guide surface 41 on the opposite side of the frame towards each other with an element (bolt 6) extending through the frame 2. The force of this compression to be transmitted to the frame is limited with a guide piece 21 comprised in the guide rail bracket, which guide piece, alone or together with a possible clearance adjusting member 61, mechanically prevents the guide surfaces (5" and 41) that face each other from being compressed to below a certain distance from each other. The guide piece functions at the same time as a guide piece that travels in the guide 11, which guide piece transmits the lateral force x (by means of the bolt 6) to the guide rail 3. The guide piece 21 as presented is a separate part, but it could be an integral part of the part 40, 5 or 6. The clearance adjusting member 61 is preferred, but not absolutely necessary. The clearance adjusting member is a shim plate, preferably a washer, through which the bolt 6 that extends through the frame travels. With the clearance adjusting member the clearance between the guide surfaces of the frame and the stationary frame of the guide surfaces and the mounting base 5 and the fixing element 40 that move in relation to the frame can be adjusted. The clearance adjusting member is most preferably (in the direction of the compression) 0.1-0.5 mm, most preferably 0.2-0.4 mm, in its material thickness.

Movability in relation to each other between the mounting base and the frame can be assisted such that the guide surface 31 and/or the surface 5" to be placed against the guide surface of the mounting base 5 are treated with a surface treatment that reduces friction, preferably by coating the surface (31 and/or 5") with a material that reduces friction and/or by polishing the surface (31 and/or 5"). The coating is most preferably a material containing Teflon, preferably sprayed onto the surface of the part to be coated.

The guide piece 21 presented essentially corresponds in its material thickness to the thickness of the frame, preferably fully corresponds to the thickness of the frame. More particularly in this case the distance from each other of the guide surfaces 3',5" and 41 that are on opposite sides of the frame 2 and that are in connection with the guide rail can be accurately regulated to be suitable, because in this way the effect of tolerance variations occurring in the thickness of the frame 2 can be eliminated. If a clearance adjusting member 61 is stacked together with the aforementioned member 21, which is of the thickness of the frame 2, between the elements 3,5 and 40 comprising the guide surfaces 3',5" and 41 that are in connection with the guide rail 3, a clearance that is precisely the magnitude of the clearance adjusting member, is formed between the guide surfaces of the frame and the guide surfaces that are in connection with the guide rail, irrespective of the thickness of the frame 2. Fitting the material thickness to be the same can be awkward owing to variations in the material thickness. According to the invention, to facilitate this the guide piece 21 is preferably cut from a piece that is of integral material with the frame, preferably from the proximity of the guide groove 11. Thus the thickness of the guide piece is automatically always at least essentially the same as the material thickness of the frame independent of the thickness variations between frame material deliveries. The guide piece 21 can be cut from the frame from a point comprising a guide surface 31. The advantage of this is that the guide piece keeps the guide surfaces at least at exactly the same distance from each other as the material thickness of the frame at the point of the guide surface. The guide piece thus bears the compression of the mounting base and of the fixing element 40 and limits the friction resulting from the fixing between the mounting base and the frame. In FIG. 3 the point 21' is referred to with a dashed line, at which point the guide piece is still drawn in its position and from where the guide piece 21 can be detached in connection with installation.

The guide rail bracket according to the invention is preferably according to that presented in FIGS. 1-3 and according to the explanation of the figures.

In the method according to the invention, in forming the guide rail line of the elevator the guide rail 3 is fixed with a guide rail bracket 1 to the building movably in relation to the building in the longitudinal direction of the guide rail 3. The guide rail 3 is fixed against the mounting base 5 immovably in relation to the mounting base 5, which mounting base 5 is fixed to the building movably in the longitudinal direction of the guide rail 3. In the method the elevator is preferably manufactured according to what is specified by any of the claims. The elevator is formed preferably to comprise the solutions according to FIGS. 1-3.

FIG. 4 presents by way of reference an elevator according to a second embodiment of the invention, as viewed from the side. The elevator comprises a guide rail line, which comprises a plurality of consecutive guide rails 3, which are supported on the building with guide rail brackets 1' fixed to the building. The guide rails 3 of the guide rail line guide the elevator unit 9 to be moved in the elevator hoistway, which elevator unit is an elevator car suited for moving passengers, or a counterweight, via guide shoes 9 traveling following the guide rails on the aforementioned elevator unit. The guide rail bracket 1' essentially prevents at its point lateral movement of the guide rail 3 in relation to the fixing point of the guide rail bracket 1' and permits longitudinal movement of the guide rail in relation to the fixing point of the guide rail bracket 1'. The fixing arrangement and the guide rail bracket 1' are presented in more detail in FIG. 5.

In the support arrangement according to the invention presented by FIG. 5, the guide rail 3 is supported on the frame 2 of the guide rail bracket 1' that is (according the invention presented in the figure) supported on the building movably in the longitudinal direction of the guide rail 3 with respect to the frame. The frame 2 of the guide rail bracket 1' comprises guide surfaces (31, 51) that face opposite sides of the frame 2, and in the arrangement on the opposite sides of the frame 2 there are guide surfaces (5", 3') and (41) that are pressed towards each other and are in connection with the guide rail, which guide surfaces face towards the guide surfaces of the frame, and which guide surfaces are fitted to move guided by the aforementioned guide surfaces (31,51) of the frame and to transmit support force (z) in the direction of the compression from the frame to the guide rail. In the embodiment presented in FIG. 4, the guide surface 3' is an integral surface of the guide rail 3 unlike that presented in connection with the earlier embodiment (FIGS. 2 and 3) in which the guide surface 5" is fixed to the guide rail 3. The arrangement further comprises members (21, 61) for keeping the aforementioned guide surfaces 3' and 41 of the guide rail at a distance from each other in the direction of the compression. These members (21, 61) are connected to move along with the guide surfaces 3' and 41 in relation to the frame and they bear the aforementioned compression and limit the transmission of the compression, at least in its entirety, to the guide surfaces of the frame 2 that are between the guide surfaces 3' and 41 that are in connection with guide rail.

The members (21, 61) comprise a guide piece 21 between the elements (3,5; 40) comprising the guide surfaces connected to the guide rail, the thickness of which guide piece corresponds to the thickness of the frame in the direction of the compression and which guide piece mechanically prevents together with the clearance adjusting member the elements 3 and 40 (and their guide surfaces) from being compressed to below a certain distance from each other. In the arrangement the guide piece 21 is connected to the guide rail 3 and functions at the same time, in addition to limiting the distance of the guide surfaces, also as a guide piece traveling in the elongated guide 11 comprised in the frame 2, and transmits support force from the guide 11 of the frame to the guide rail 3 in the second horizontal direction x. The frame 2 comprises a frame part, which is of plate material, and which frame part comprises the aforementioned guide slot 11 and the aforementioned guide surfaces (31,51) that face opposite directions of the frame, which guide surfaces can transmit in the second horizontal direction (z) support force to the guide rail. The side walls of the guide slot 11 form longitudinal guide surfaces 11*a*, 11*b* of the guide slot for guiding the guide piece 21 traveling in the guide slot, which guide piece 21 comprises guide surfaces 21*a* and 21*b* corresponding to the guide surfaces 11*a*, 11*b*.

Movability with respect to each other between the guide surfaces can be assisted such that at least a part of the guide surfaces 3',31,51,41 are treated with a surface treatment that reduces friction, preferably by coating the surface with a material that reduces friction and/or by polishing the surface. The coating is most preferably a material containing Teflon, preferably sprayed onto the surface of the part to be coated. Most preferably at least the guide surface 31 of the frame as well as the guide surface 51 or 41 are treated in this way.

FIG. 6 presents a detail of FIGS. 3 and 5 as viewed from the direction of the guide rail and FIG. 7 presents a section 7-7 from FIG. 3 or 4. The guide rail clamp of the embodiment of FIG. 3 is described with a dashed line. The other parts presented in the figure are compacted with the means 6 and 7. In compression the members (21, 61) keep the guide surfaces (5", 3') and (41) of the guide rail at a distance from each other in the direction of the compression. This is achieved with the members (21, 61), which comprise the guide piece 21 and the clearance adjusting member 61 that are between the elements (3,5; 40) comprising the guide surfaces of the guide rail, which means mechanically prevent the means (3, 5; 40) comprising the guide surfaces of the guide rail from being compressed to below a certain distance from each other. They bear the aforementioned compression and limit the transmission of the compression, at least in its entirety, to the guide surfaces (3',5" and 41) of the frame. Between the elements (3,5; 40) comprising guide surfaces is, as presented, a guide piece 21 stacked in the direction of the compression, the thickness of which guide piece corresponds to the thickness of the frame in the direction of the compression, and also a clearance adjusting member 61, which guide piece and clearance adjusting member together keep the guide surfaces (5", 3') and (41) at a distance from each other, which distance is the thickness of the aforementioned member (guide piece 21)+ the thickness of the clearance adjusting member (61). The clearance adjusting member 61 is a shim plate, which is preferably 0.1-0.5 mm, most preferably 0.2-0.4 mm in its material thickness in the direction of the compression. When the thickness of the guide piece corresponds as presented to the thickness of the frame, the thickness of the regulating means sets the clearance between the stationary frame 2 and the guide surfaces 5", 3' and 41 that are on opposite sides of the frame and that move in relation to the frame. The guide piece 21 and the clearance adjusting member are stacked/pressed face-to-face such that the clearance adjusting member does not reach to extend against the guide surface. That being the case, it is advantageous to form the clearance adjusting member 61 at least in the x direction to be the width of the guide groove or narrower than the guide groove 11.

In the method according to the invention for manufacturing a guide rail bracket of an elevator, the frame part of the guide rail bracket is manufactured by cutting the frame part from plate, preferably from metal plate. An elongated guide slot, which is an elongated hole extending through the frame part, is machined in the frame part, the side walls of which guide slot form longitudinal guide surfaces 11*a*, 11*b* of the guide slot for guiding the guide piece traveling in the guide slot. In the method a guide piece to be guided in the guide slot is manufactured and means (6, 7) are provide for fixing the guide rail to the guide rail bracket to be guided by the guide piece 21 and the guide slot 11. In the method the guide piece 21 is formed to correspond in its material thickness to the material thickness of the frame part. This is done such that the guide piece 21 is manufactured by cutting it from a plate that is of integral material with the frame part 2, preferably from the proximity of the guide slot 11. The guide piece can be detached from the plate already at the factory. If so desired, the guide piece is detached from the plate only in connection with installation by means of the arrangement presented with a dashed line in FIG. 3, wherein the guide piece is already cut essentially into its shape but it is still structurally attached to the plate and is not yet detached from the plate.

Generally speaking, the guide surface can be an integral surface 3' of the guide rail (in this case preferably a flat rear surface of the guide rail) or a surface (5",41) of a separate element (5, 40) connected to the guide rail. Since the guide surfaces (5", 3') and (41) are in connection with the guide rail, as a consequence they move along with the guide rail (3).

It is obvious to the person skilled in the art that the invention is not limited to the embodiments described above, in which the invention is described using examples, but that many adaptations and different embodiments of the invention are possible within the frameworks of the inventive concept defined by the claims presented below. It is obvious, inter alia, that the elevator can also comprise guide rail brackets of other types in addition to those presented. It is also obvious that washers can be added to the structure.

The invention claimed is:

1. An elevator comprising:

a guide rail line including a plurality of consecutive guide rails, each of the plurality of consecutive guide rails being supported on a building by at least one guide rail bracket fixed to the building, the at least one guide rail bracket including a frame and a mounting base, wherein the frame includes a frame part having at least one guide slot, wherein a fixing includes a fixing member extending through the at least one guide slot, the fixing arrangement being configured to press a corresponding guide rail, from among the plurality of consecutive guide rails, against the mounting base, and to attach the mounting base to the frame part, wherein the at least one guide rail bracket is configured to prevent lateral movement of the corresponding guide rail relative to a fixing point of the at least one guide rail bracket, wherein the at least one guide rail bracket is configured to permit movement of the corresponding guide rail and the mounting base relative to the fixing point in a longitudinal direction of the corresponding guide rail, and wherein the at least one guide slot extends in the longitudinal direction of the corresponding guide rail, and is configured to guide the permitted movement of the corresponding guide rail in the longitudinal direction of the corresponding guide rail.

2. The elevator according to claim 1, further comprising:

a guide piece in the at least one guide slot;

wherein the fixing member extends through the guide piece within the at least one guide slot;

wherein the guide piece is configured to transfer support force from the at least one guide slot to at least one of the corresponding guide rail and the mounting base in a first horizontal direction;

wherein the frame part includes first and second guide surfaces facing opposite directions, the first guide surface being configured to guide a surface of the mounting base at the first guide surface, and the second guide surface being configured to guide a fixing element at the second guide surface, the first and second guide surfaces being further configured to transfer, in a second horizontal direction, a support force to at least one of the corresponding guide rail and the mounting base;

wherein the surface of the mounting base is supported against the first guide surface by pressing the mounting base and a surface of the fixing element towards each other and against the guide piece; and wherein the guide piece has a thickness corresponding to a thickness of the frame.

3. The elevator according to claim 2, wherein the surface of the mounting base is supported against the first guide surface by pressing the mounting base and the fixing element towards each other with the fixing member extending through the at least one guide slot; and the at least one guide rail bracket includes at least one spacing member configured to maintain the surface of the mounting base and the surface of the fixing element at a distance from each other.

4. The elevator according to claim 3, wherein the at least one spacing member is further configured to mechanically prevent the surface of the mounting base and the surface of the fixing element from being compressed below a certain distance from each other, the at least one spacing member having a thickness corresponding to the thickness of the frame.

5. The elevator according to claim 1, wherein the mounting base is movably fixed to the frame of the at least one guide rail bracket such that the mounting base is configured to move in the longitudinal direction of the corresponding guide rail against a vertical guide surface of the frame.

6. The elevator according to claim 5, wherein at least one of the vertical guide surface and a surface of the mounting base is treated with a surface treatment that reduces friction.

7. The elevator according to claim 5, wherein the mounting base is supported against the vertical guide surface of the frame by pressing the mounting base and a fixing element towards each other with the fixing member extending through the at least one guide slot.

8. The elevator according to claim 7, wherein the fixing member is a bolt configured to transfer the guidance of the at least one guide slot to at least one of the mounting base and the corresponding guide rail.

9. A guide rail bracket to support a guide rail on a building, the guide rail bracket comprising:

a frame including a frame part having at least one guide slot;

a mounting base;

a pressing member configured to press the guide rail against the mounting base;

a fixing arrangement including a fixing element extending through the at least one guide slot, the fixing arrangement being configured to press the guide rail against the mounting base, and to attach the mounting base to the frame part;

wherein the guide rail bracket is configured to prevent lateral movement of the guide rail relative to a fixing point of the guide rail bracket;

wherein the guide rail bracket is configured to permit movement of the guide rail and the mounting base relative to the fixing point in a longitudinal direction of the guide rail; and wherein the at least one guide slot extends in the longitudinal direction of the guide rail, and is configured to guide the permitted movement of the guide rail in the longitudinal direction of the guide rail.

10. The guide rail bracket according to claim 9, further comprising:

a guide piece in the at least one guide slot;

wherein the fixing element extends through the guide piece in the at least one guide slot;

wherein the guide piece is configured to transfer support force from the at least one guide slot to at least one of the guide rail and the mounting base in a first horizontal direction;

wherein the guide piece has a thickness corresponding to a thickness of the frame; and wherein the mounting base is supported against a guide surface of the frame by pressing a guide surface of the mounting base and the fixing element against the guide piece.

11. The guide rail bracket according to claim 10, wherein the guide piece includes a spacing member manufactured from a plate that is of integral material with the frame part of the frame.

12. The guide rail bracket according to claim 9, further comprising:

a guide arrangement configured to guide movement between the mounting base and the frame in the longitudinal direction of the guide rail such that the guided movement occurs only in the longitudinal direction of the guide rail.

13. The guide rail bracket according to claim 9, wherein the fixing element is a bolt configured to transfer the guidance of the at least one guide slot to at least one of the mounting base and the guide rail.

14. The guide rail bracket according to claim 9, wherein the guide piece is further configured to transfer support force from the at least one guide slot to at least one of the guide rail and the mounting base in a first horizontal direction; and the frame part further includes first and second guide surfaces facing opposite directions, the first guide surface being configured to guide a surface of the mounting base at a first surface of the frame, and the second guide surface being configured to guide the fixing element on a second, opposite side of the frame, the first and second guide surfaces being further configured to transfer, in a second horizontal direction, a support force to at least one of the guide rail and the mounting base.

15. A support arrangement of a guide rail of an elevator, the support arrangement comprising:

a guide rail bracket supported by a building, the guide rail bracket including a frame supporting the guide rail, the frame including a frame part having at least one guide slot, a mounting base attached to the guide rail and the frame by a fixing arrangement including a fixing member extending through the at least one guide slot, the fixing arrangement being configured to press the guide rail against the mounting base, and to attach the mounting base to the frame part;

a spacing member arranged in the at least one guide slot, the fixing member extending through the spacing member in the at least one guide slot, and the spacing member being configured to maintain, at a distance from each other in a direction of compression, guide surfaces at opposite sides of the frame and that are compressed together in contact with the guide rail;

wherein the guide surfaces are configured to transfer support force from the frame to the guide rail in the direction of the compression;

wherein the guide rail bracket is configured to prevent lateral movement of the guide rail relative to a fixing point of the guide rail bracket;

wherein the guide rail bracket is configured to permit movement of the guide rail and the mounting base relative to the fixing point in a longitudinal direction of the guide rail; and wherein the at least one guide slot extends in the longitudinal direction of the guide rail, and is configured to guide the permitted movement of the guide rail in the longitudinal direction of the guide rail.

16. The arrangement according to claim 15, wherein the spacing member comprises:

a spacing element between the guide surfaces contacting the guide rail, a thickness of first spacing element corresponding to a thickness of the frame in the direction of the compression.

17. The arrangement according to claim 16, wherein the spacing element is manufactured from a plate that is of integral material with at least a portion of the frame.

18. The arrangement according to claim 15, wherein the spacing member bears the compression, and limits the transfer of compression force to the guide surfaces at the opposite sides of the frame and in contact with the guide rail.

19. The arrangement according to claim 15, wherein the spacing member is configured to mechanically prevent the guide surfaces contacting the guide rail from being compressed to less than a threshold distance from each other.

20. The arrangement according to claim 15, wherein the spacing member comprises:

a spacing element stacked in the direction of the compression between the guide surfaces contacting the guide rail, a thickness of the spacing element corresponding to a thickness of the frame in the direction of the compression; and at least one clearance adjusting element configured to maintain the guide surfaces at a threshold distance from each other, the threshold distance being equal to the thickness of the spacing element and a thickness of the at least one clearance adjusting member.

21. The arrangement according to claim 15, wherein the direction of the compression is a first horizontal direction; and the spacing member is a guide piece configured to travel in the at least one guide slot, and to transfer support force from the frame to the guide rail in a second horizontal direction, the second horizontal direction being perpendicular to the first horizontal direction.

22. The arrangement according to claim 15, wherein at least one guide slot is an elongated guide slot, which is elongated in the longitudinal direction of the guide rail.

23. The arrangement according to claim 15, wherein at least one element including a guide surface that is in connection with the guide rail is fixed to the guide rail.

24. The arrangement according to claim 15, wherein the spacing member includes a guide piece configured to transfer support force from the at least one guide slot to the guide rail in a first horizontal direction; and the guide surfaces at the opposite sides of the frame are configured to transfer support force to the guide rail in a second horizontal direction.

25. The arrangement according to claim 15, wherein at least a part of the guide surfaces are treated with a surface treatment that reduces friction.

26. The arrangement according to claim 15, wherein the fixing member is a bolt extending through the at least one guide slot; and a nut is arranged on a threaded end of the bolt.

27. An elevator comprising:

a movable elevator unit; and a guide rail line configured to guide the movable elevator unit, the guide rail line including a plurality of consecutive guide rails supported on the building by a support arrangement according to claim 15; wherein the movable elevator unit is one of an elevator car and a counterweight.

28. A guide rail bracket to support a guide rail on a building, the guide rail bracket comprising:

a frame including guide surfaces on opposite sides of the frame, the frame further including a plurality of guide slots;

a plurality of pressing arrangements, each of the plurality of pressing arrangements including a pressing member, each of the pressing members passing through a corresponding one of the plurality of guide slots, and each of the plurality of pressing arrangements being configured to compress guide surfaces of elements at the opposite sides of the frame towards each other and towards the guide surfaces on opposite sides of the frame, and to guide the guide surfaces of elements at the opposite sides of the frame;

a plurality of spacing members, each of the plurality of spacing members being arranged in a corresponding one of the plurality of guide slots such that a corresponding one of the pressing members extends through a corresponding spacing member in the corresponding guide slot, and the plurality of spacing members being configured to maintain a threshold distance between the guide surfaces of the elements in a direction of the compression;

wherein the guide rail bracket is configured to prevent lateral movement of the guide rail relative to a fixing point of the guide rail bracket;

wherein the guide rail, the pressing members and the plurality of spacing members are configured to move in a longitudinal direction of the guide rail relative to the frame; and wherein each of the plurality of guide slots extends in the longitudinal direction of the guide rail, and is configured to guide the permitted movement of the guide rail in the longitudinal direction of the guide rail.

29. The guide rail bracket according to claim 28, wherein each of the plurality of spacing members includes a spacing element between the elements in contact with the guide rail, a thickness of the spacing elements corresponding to a thickness of the frame in the direction of the compression.

30. The guide rail bracket according to claim 29, wherein the direction of the compression is a first horizontal direction; and each spacing element is a guide piece configured to travel in a corresponding one of the plurality of guide slots, the guide piece being further configured to transfer the support force from the frame to the guide rail in a second horizontal direction, which is perpendicular to the first horizontal direction.

31. The guide rail bracket according to claim 30, wherein the plurality of guide slots are elongated guide slots, each of the elongated guide slots being elongated in the longitudinal direction of the guide rail.

32. The guide rail bracket according to claim 30, wherein each of the plurality of spacing members comprises:

a spacing element stacked in the direction of the compression between the elements in contact with the guide rail, a thickness of the spacing element corresponding to a thickness of the frame in the direction of the compression; and at least one clearance adjusting member configured to maintain the guide surfaces of the elements at a threshold distance from each other, the threshold distance corresponding to the thickness of the spacing element and a thickness of the at least one clearance adjusting member.

33. The guide rail bracket according to claim 32, wherein the at least one clearance adjusting member is a shim plate.

34. The guide rail bracket according to claim 33, wherein the shim plate is a metallic shim plate having a thickness less than or equal to about 0.5 mm in the direction of the compression.

35. The guide rail bracket according to claim 32, wherein the at least one clearance adjusting member is a metal bushing.

36. The guide rail bracket according to claim 30, wherein the plurality of spacing members are fitted to bear the compression force and to limit transfer of the compression force to the guide surfaces on opposite sides of the frame.

37. The guide rail bracket according to claim 30, wherein the plurality of spacing members are configured to mechanically prevent the elements from being compressed less than the threshold distance from each other.

38. The guide rail bracket according to claim 30, wherein at least a part of at least one of the guide surfaces on opposite sides of the frame and the guide surfaces of the elements are treated with a surface treatment that reduces friction.

39. The guide rail bracket according to claim 30, wherein a thickness of the frame corresponds to a distance between the guide surfaces on the opposite sides of the frame.

* * * * *